United States Patent [19]

Blanchard

[11] Patent Number: 5,056,248

[45] Date of Patent: Oct. 15, 1991

[54] BRAND IDENTIFICATION SYSTEM

[75] Inventor: Russell O. Blanchard, Zeeland, Mich.

[73] Assignee: Batts, Inc., Zeeland, Mich.

[21] Appl. No.: 510,024

[22] Filed: Apr. 17, 1990

[51] Int. Cl.[5] ..... G09F 3/06

[52] U.S. Cl. ..... 40/322; 40/661; 40/316; 24/543; 223/88; 223/85

[58] Field of Search ..... 40/661, 647, 644, 652, 40/658, 322; 24/551, 552, 563, 543, 457, 458; 223/85, 90, 92

[56] References Cited

U.S. PATENT DOCUMENTS

| | | | |
|---|---|---|---|
| D. 299,593 | 1/1989 | Blanchard | D6/319 |
| 1,080,836 | 12/1913 | Lake | 24/563 |
| 1,402,153 | 1/1922 | Dusinberre | 24/543 |
| 2,583,020 | 1/1952 | Smith | 24/551 |
| 2,690,863 | 10/1954 | Adelman | 223/92 |
| 2,777,619 | 1/1957 | Cook | 223/90 |
| 3,140,519 | 7/1964 | Johnson | 24/563 |
| 3,240,462 | 3/1966 | Schneider | 223/85 |
| 3,767,092 | 10/1973 | Garrison et al. | 24/251 |
| 3,790,044 | 2/1974 | Verdile | 223/92 |
| 4,017,990 | 4/1977 | Garrison | 40/322 |
| 4,101,059 | 7/1978 | Batts et al. | 40/322 |
| 4,115,940 | 9/1978 | Phillips | 40/322 |
| 4,123,864 | 11/1978 | Batts et al. | 40/316 |
| 4,333,590 | 6/1982 | Princiotta | 40/322 |
| 4,450,639 | 5/1984 | Duester | 40/322 |
| 4,556,060 | 12/1985 | Perlin | 24/552 |
| 4,638,930 | 1/1987 | Blanchard | 223/85 |
| 4,736,538 | 3/1988 | Pierce et al. | 40/156 |
| 4,897,900 | 2/1990 | Baggett | 24/543 |

FOREIGN PATENT DOCUMENTS

| | | | |
|---|---|---|---|
| 655749 | 1/1938 | Fed. Rep. of Germany | 40/316 |
| 2251859 | 3/1974 | Fed. Rep. of Germany | 40/647 |
| 8304122 | 11/1983 | PCT Int'l Appl. | 40/322 |
| 1151407 | 5/1969 | United Kingdom | 40/322 |

*Primary Examiner*—Laurie K. Cranmer
*Assistant Examiner*—Cassandra L. Hope
*Attorney, Agent, or Firm*—Price, Heneveld, Cooper, DeWitt & Litton

[57] ABSTRACT

A brand identification system or label holder for use with a garment hanger or other display device includes first and second panels hingedly connected along upper lateral edges. The panels are movable from an open position to a closed position wherein inner faces of the panels are in opposed relationship. The panels include opposed clamps or hooks which are positioned to snap over the display device when the panels are in the closed position. A living hinge between the panels resiliently biases the panels towards an open position to increase the clamping force generated by the clamp members. A product information card or label may be positioned between the panels.

17 Claims, 2 Drawing Sheets

BRAND IDENTIFICATION SYSTEM

BACKGROUND OF THE INVENTION

The present invention relates to article display devices and more particularly to an identification system, holder or attachment for a display device such as a hanger.

In the display and sale of various articles such as clothing, garments, carpet samples and the like, special information may need to be provided to the customer. The information may relate to pricing, style, sales, quantities, brand identification and the like. To be effective, it is important that such information be positioned to be seen clearly.

Heretofore, various proposals have been made for presenting additional information. The display devices or garment hangers themselves may include an integral label area generally below the hook. Necessary brand identification or other information may be printed on the label area or molded integrally during the manufacture of the hanger. In the alternative, such information may be printed on labels which are physically applied to the hanger body. An example of a hanger including a central label area may be found in commonly owned U.S. Pat. No. 299,593 which issued on Jan. 31, 1989 to the present inventor. Due to its positioning, the label area may be covered depending upon the type of garment which is suspended on the hanger.

With other types of hangers such as disclosed in commonly owned, U.S. Pat. No. 3,767,092 entitled Garment Clamping Hanger with Slidable Locking Clip and which issued on Oct. 23, 1973 to Garrison et al, a label or other display area is not included. Hangers of this type suspend slacks, pants, skirts, carpet samples and the like. The body of the hanger is essentially covered by the article.

Other approaches to displaying additional product information include tally systems. Examples of such systems may be found in commonly owned, U.S. Pat. No. 4,017,990 entitled Accessory for Article Display Tally and which issued on Apr. 19, 1977 to Garrison. The '990 patent discloses a generally circular or cylindrical tally which surrounds the shank or support hook of the hanger. An additional attachment is inserted into the open top of the tally. The attachment may contain additional product or brand information. The attachment is retained on the tally only through a frictional interfit. Other examples of tally systems may be found in U.S. Pat. No. 4,101,059 entitled Tally and which issued on July 18, 1978 to Batts et al and U.S. Pat. No. 4,123,864 entitled Tally for Article Displays and which issued on Nov. 7, 1978 to Batts et al.

Problems have been experienced with prior devices. For example, the information may be covered by the garment or other article suspended. In addition, prior tally approaches have been limited in size and hence in the amount of information which may be displayed. Problems have also been experienced with the positive retention of the information display devices on the hangers.

SUMMARY OF THE INVENTION

In accordance with the present invention, the aforementioned problems are substantially eliminated. Essentially, a device for displaying information on an article hanger is provided which includes a pair of panels or plates joined together along upper lateral edges. A clamp means is provided adjacent lower lateral edges of the panels. The clamp means is configured so as to snap over a portion of the article hanger.

In narrower aspects of the invention, provision is made for increasing the clamping force thereby retaining the device on the hanger in a positive fashion. The device will support an information card or label. The clamp means is adapted to engage a configured portion of the hanger thereby presenting the information for display above the garment, carpet or other article suspended by the hanger and to the side of any support or suspension hook.

In the preferred form, the panels are interconnected by a resilient, living hinge and the panels are molded from a suitable plastic material integral with the hinge. The panels may be transparent or opaque and provide increased surface are for displaying information from that heretofore available. The device permits the ready display of brand identification, style information, size information, pricing and sales information, and the like.

DETAILED DESCRIPTION OF THE PREFERRED EMBODIMENTS

Figure 1:
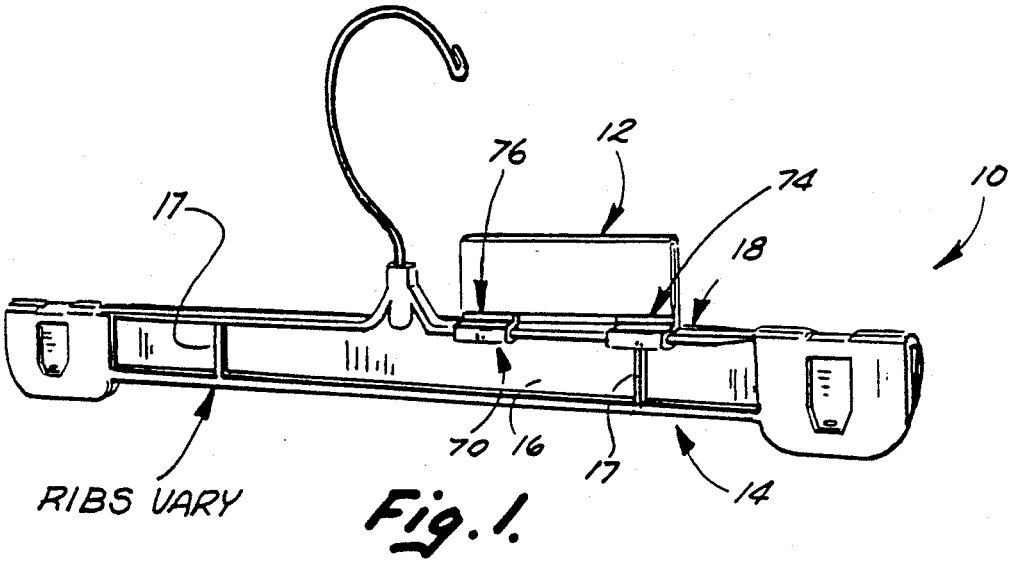
FIG. 1 is a perspective view an article hanger and identification device in accordance with the present invention.

With reference to the drawings, FIG. 1 illustrates an article suspension and display device or hanger which is generally designated by the numeral 10. A label holder, device or identification system 12 in accordance with the present invention is positioned on hanger 10. Hanger 10 is a commercially available product which includes an elongated body 14. Body 14 includes a central, vertical web 16 and an upper top section in the form of an elongated flange or bead 18. Vertical ribs 17 may be formed on front and back surfaces of web 16. The hanger body has a generally I-beam cross-sectional configuration. As shown, flange 18 extends outwardly from opposite sides of central web 16. Hanger 10 is shown for illustrative purposes. The present invention, as described in more detail below, may be used with hangers having other cross-sectional shapes such as C-sections, T-sections and the like. The present invention is principally adapted for use with hangers having a configured top section in the body or bar of the hanger.

Figure 2:
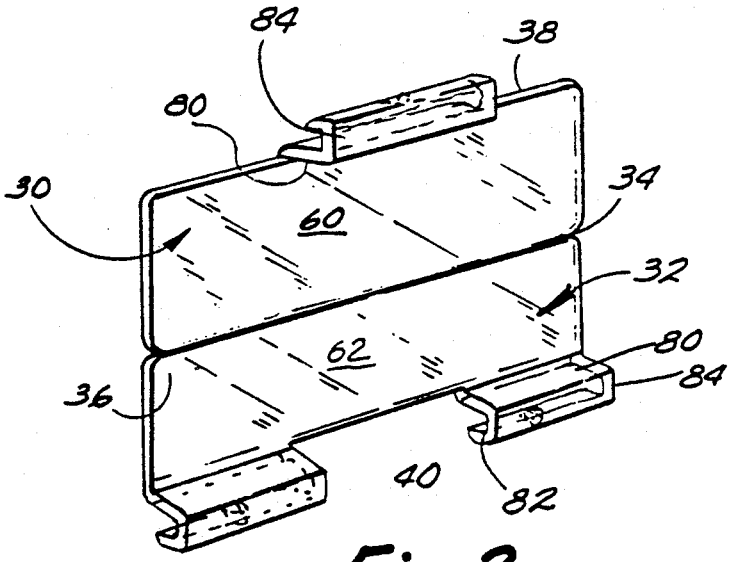
FIG. 2 is a perspective view showing the identification device in accordance with the present invention in an open position.
Figure 4:
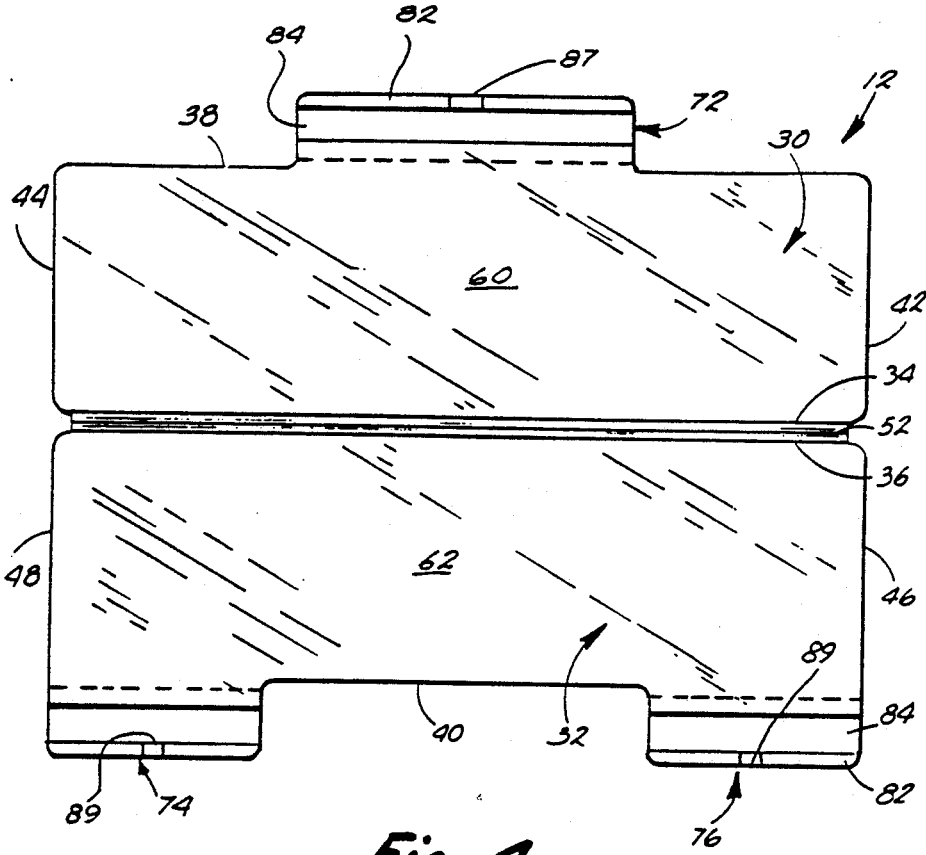
FIG. 4 is a plan view of the device.
Figure 5:
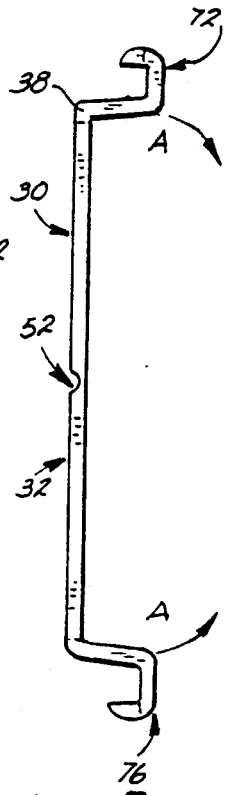
FIG. 5 is a side, elevational view of the device.

As best seen in FIGS. 2, 4 and 5, label holder or the identification device 12 includes a pair of panels or plates 30, 32. In the preferred form, plates 30, 32 are of identical dimensions and are generally rectangular in shape. The plates define information display surfaces. Each includes an inner or upper lateral edge portion 34, 36 and lower or outer lateral edge portion 38, 40. Panels 30, 32 further include ends 42, 44 and 46, 48, respectively.

Figure 3:
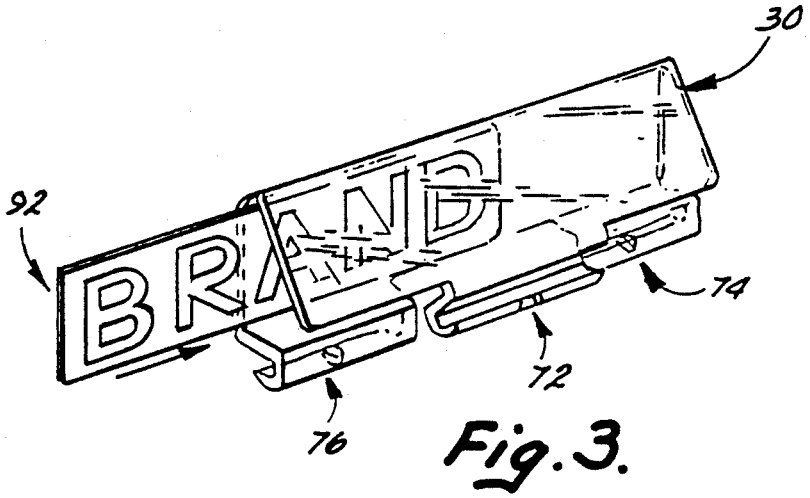
FIG. 3 is a perspective view showing the device in a partially closed position.
Figure 6:
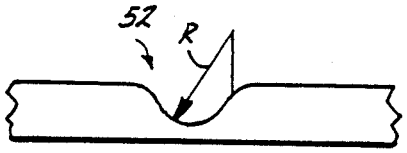
FIG. 6 is an enlarged, fragmentary, side elevational view showing the living hinge incorporated in the present invention.

As seen in FIGS. 4, 5 and 6, panels 30, 32 are joined together by a resilient hinge 52. Hinge 52 has a reduced cross-sectional thickness from that of panels 30, 32. The configuration of the hinge is defined by a radius "r". In the preferred form, device 12 is molded from a suitable plastic material such as a styrene-butadiene copolymer. One such material is sold under the brand name K-Resin KRO-3. Other suitable plastic materials having similar physical properties may be used. It is preferred that the plastic material have sufficient toughness, resilience, and flexural strength to permit repeated flexing of the panels about hinge portion 52 towards and away from each other. Panels 30, 32 flex about the living hinge in the direction of arrows "A" as shown in FIG. 5. Inner surfaces 60, 62 of panels 30, 32, respectively, may be moved from an open position as illustrated in FIGS. 2 and 5 towards each other to a closed position in facing, opposed relationship, as illustrated in FIGS. 1 and 3. Panels 30, 32 and hinge 52 define a holder, as explained in more detail below.

An attachment structure or clamp means generally designated 70 in FIG. 1 is provided to secure plates 30, 32 onto top section 18 of hanger 10. In the preferred form, plate or panel 30 is provided with the clamp member or jaw 72 which extends outwardly from lateral edge portion 38. As illustrated, clamp member 72 is positioned centrally of ends 42, 44. Panel or plate 32 is provided with a pair of spaced clamp members or jaws 74, 76. Jaws 74, 76 extend laterally towards each other from points immediately adjacent lateral edges 48, 46, respectively. The spacing between clamp members 74, 76 is sufficient to receive or accommodate clamp member 72.

Figure 7:
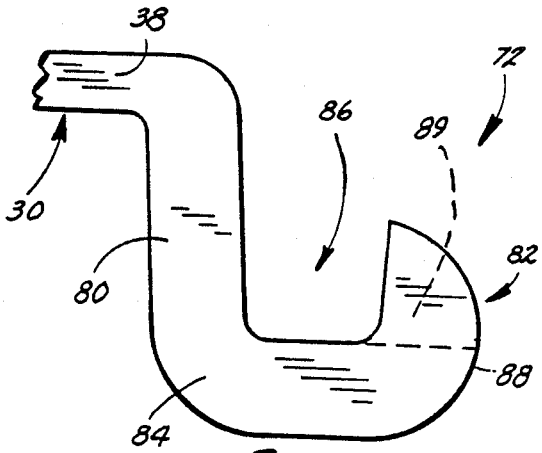
FIG. 7 is an enlarged, fragmentary, elevational view of one of the clamp members incorporated in the present invention.

As best seen in FIGS. 4, 5 and 7 each of the clamp members 72, 74 and 76 has a generally C-shape in cross section. The members each include a first leg or portion 80 joined to a respective lower lateral edge of the panels. Leg portion 80 extends generally perpendicular to its respective panel. Each clamp member further includes a second leg 82 which is joined to a base portion 84. Legs 80, 82 and base portion 84 define an open channel or groove 86. Leg portion 82 includes a curvilinear outer surface 88 (FIG. 7) which functions as a camming surface during attachment of the device to the hanger. In addition, each leg 82 defines a locator notch 89. Each notch extends to base portion 84. The notches, as explained below, cooperate with ribs 17 to position and locate the device 12 on body 14.

It is preferred that clamp members 72, 74 and 76 be molded integral with their respective panels 30, 32 during the manufacturing process. Due to the configuration of the device 12, it may be molded in a simple, two-piece mold without the use of inserts or cams.

As seen in FIGS. 2 and 3, when the panels 30, 32 are folded about hinge 52 by moving the clamp members towards each other, clamp member 72 passes by lower lateral edge 40 of clamp member 32 and into the space between clamp members 74, 76. Legs 80 of the clamp members define a ledge. If the panels 30, 32 are fabricated from a clear or translucent plastic material, a brand or information identification card or label 92 may be positioned between opposed faces 60, 62. The label is retained within the device by the upper living hinge 52 and the clamp members or jaws. In the alternative, a label could be affixed to the outer surfaces 90 of the panels. Also, information could be imprinted on the surfaces or molded integrally therein.

When in the closed position, legs 84 of the jaws assume a generally vertical orientation with legs 80, 82 extending in a generally horizontal plane. Channel 86 of jaw 72 opens in a direction opposite from and opposed to the opening of channels 86 of jaws 74, 76. The jaws, therefor, define an elongated channel configured and dimensioned to receive top section 18 of hanger body 14.

Due to the dimensioning of the elements of the holder and the resiliency of the jaws, the holder may be moved to the closed position and snap fitted over top section 18. The user will press downwardly on the device so that the camming surfaces 88 engage the top section. The configuration of these surfaces forces the jaws or clamp members outwardly until they snap over outer lateral edges of top section 18. The jaws then capture the top section. If the hanger body has ribs 17, at least one may be received in a locator notch 89. When so positioned, device 12 will not be moveable along the top section of the hanger body.

Hinge 52 functions as resilient biasing means or spring which tends to move opposed faces 60, 62 away from each other. This spring action generates a clamping force serving to snugly and tightly retain the top section of the hanger within the channel defined by the clamp members. This action maintains the clamp members in positive engagement with the hanger body.

As seen in FIG. 1, device 12 is mounted above the top section of the hanger body and is readily visible by the customer. The device is placed to the side of support hook 20. The plates may be squeezed together against the resilient biasing action of the hinge 52 opening the jaws and permitting the device to be easily slid along the length of the hanger body if a rib 17 is not engaged. The holder or identification system permits the display of a wide range of information.

When formed from clear plastic material, the information cards or labels 92 may be readily interchanged or replaced. In the alternative, adhesive labels may be directly applied to the outer or exposed surfaces 90 of the panels 30, 32. Further, the device may be molded from opaque plastic material and appropriate brand identification or other information imprinted directly thereon. The device provides great versatility and permits an information card or label to be protected inside of the holder.

The configuration of the jaws or clamp members provides for easy attachment to the garment hanger body. The channels 86 of the jaws are configured to conform to the top cross-sectional shape of the hanger body. The configuration of the jaws may be modified to accommodate different cross-sectional configurations. Further, the configuration of members 30, 32 may be modified to accommodate a hanger having angled support arms and the like. For example, the panels could be triangular in shape, square or circular.

The label holder permits a significant increase in the surface area provided for display of information from that heretofore available. The information is presented closer to the customer and an increase in the ease of viewing of the information results. Since a positive clamping action is present, the device can not be dislodged through normal use of the hanger. The device is relatively easily and inexpensively manufactured. Significant advantages are present when compared to prior tally or information systems.

In view of the above description, those of ordinary skill in the art may envision various modifications which would not depart from the inventive concepts disclosed herein. For example, multiple sets of clamp members could be employed in an alternating arrangement. The opposed orientation of the clamp members could be repeated laterally several times depending upon the overall length of the device. It is expressly intended, therefore, that the above should be considered as only the description of the preferred embodiment. The true spirit and scope of the present invention may be determined by reference by the appended claims.

The embodiments of the invention in which an exclusive property or privilege is claimed are defined as follows:

1. A device for displaying information including an article hanger of the type having a body which defines an upper, configured portion, said device further comprising:

a pair of plates, each plate including an inner face, an outer face and upper and lower lateral edges;

hinge means joined to said plates for hingedly interconnecting said plates along said upper lateral edges for movement between an open position and a closed position with the inner faces of said plates in an opposed relationship and for resiliently biasing said plates towards said open position; and clamp means o the lower lateral edges of said plates for engaging the article hanger with said hinge means resiliently biasing said clamp means into clamping engagement with the article hanger, said clamp means defining a channel dimensioned to receive the hanger and including portions defining outer, curved camming surfaces which are configured to cam over the article hanger so that the clamp means snaps over the hanger.

2. A device for displaying information on an article hanger of the type having a body which defines an upper, configured portion, said device comprising:

a pair of plates, each plate including an inner face, an outer face and upper and lower lateral edges;

hinge means joined to said plates for hingedly interconnecting said plates along said upper lateral edges for movement between an open position and a closed position with the inner faces of said plates in an opposed relationship and for resiliently biasing said plates towards said open position;

clamp means on the lower lateral edges of said plates for engaging the article hanger with said hinge means resiliently biasing said clamp means into clamping engagement with the article hanger; and an information card positioned between said plates when said plates are in the closed position.

3. A device as defined in claim 1 wherein said hinge means comprises a resilient, integral living hinge joined to the upper lateral edges of said plates.

4. A device as defined in claim 1 wherein said clamp means comprises:

a first clamp member on one of said plates, said clamp member dimensioned and configured to extend past the lower lateral edge of the other of said plates when the plates are in the closed position; and a second clamp member on the other of said plates, said second clamp member dimensioned and configured to extend past the lower lateral edge of said one of said plates when the plates are in the closed position.

5. A device as defined in claim 4 wherein said clamp means further comprises:

a third clamp member on the other of said plates in laterally spaced relationship with said second clamp member, said third clamp member dimensioned and configured to extend past the lower lateral edge of said one of said plates when the plates are in the closed position.

6. A device as defined in claim 5 wherein said first clamp member is between said second and third clamp members when said plates are in the closed position.

7. A device as defined in claim 6 wherein said clamp members define inwardly opening hooks, each of said hooks defining said outer, curved camming surface.

8. A device as defined in claim 3 wherein said clamp means comprises:

a first clamp member on one of said plates, said clamp member dimensioned and configured to extend past the lower lateral edge of the other of said plates when the plates are in the closed position; and a second clamp member on the other of said plates, said second clamp member dimensioned and configured to extend past the lower lateral edge of said one of said plates when the plates are in the closed position, at least one of said clamp members defining a locator notch.

9. A device as defined in claim 7 wherein said hinge means comprises a resilient, integral living hinge joined to the upper lateral edges of said plates.

10. A device for displaying information on an article hanger of the type having a body which defines an upper, configured portion, said device comprising:

a pair of plates, each plate including an inner face, an outer face and a upper and lower lateral edges;

hinge means joined to said plates for hingedly interconnecting said plates along said upper lateral edges for movement between an open position and a closed position with the inner faces of said plates in an opposed relationship and for resiliently biasing said plates towards said open position;

clamp means on the lower lateral edge of said plates for engaging the article hanger with said hinge means resiliently biasing said clamp means into clamping engagement with the article hanger, said clamp means comprising:

a first clamp member on one of said plates, said clamp member dimensioned and configured to extend past the lower lateral edge of the other of said plates when the plates are in the closed position;

a second clamp member on the other of said plates, said second clamp member dimensioned and configured to extend past the lower lateral edge of said one of said plates when the plates are in the closed position; and a third clamp member on the other of said plates in laterally spaced relationship with said second clamp member, said third clamp member dimensioned and configured to extend past the lower lateral edge of said one of said plates when the plates are in the closed position, said first clamp member being between said second and third clamp members when said plates are in the closed position, said clamp members defining inwardly opening hooks, each of said hooks defining an outer, curved camming surface, said hinge means comprising a resilient, integral living hinge joined to the upper lateral edges of said plates; and wherein said device further includes an information card positioned between said joined plates when said plates are in the closed position.

11. An information display system including a hanger having a configured upper section, said system further comprising:

an information display member defining a display surface adapted to receive information thereon, said display member having a lower lateral edge portion; and attachment means on the lower lateral edge portion of said member for positively attaching said member to the upper section of the hanger in a resilient snap fit manner so that the member stands up from the hanger, said attachment means defining an elongated downwardly opening channel dimensioned to receive the hanger upper section, and said attachment means defining outer camming surfaces.

12. A system as defined by claim 11 when said attachment means comprises:

a pair of first and second jaws joined to the lower lateral edge portion in a laterally spaced relationship, said jaws configured to define an outwardly opening channel; and a third jaw joined to the lower lateral edge portion intermediate said first and second jaws, said third jaw defining a channel opening in a direction generally opposite the direction of opening of the channels of said first and second jaws, said jaws defining said camming surfaces and being configured to snap over and to receive the upper section of the hanger.

13. A system as defined by claim 12 wherein said display member comprises:

a pair of panels, each panel including an upper lateral edge; and joining means on said panels for joining said panels at said upper lateral edges.

14. A system as defined by claim 13 wherein said jaws each define outer camming surfaces and said joining means is a resilient living hinge.

15. A system as defined by claim 14 wherein said jaws, said panels and said hinge are integrally molded from a plastic material.

16. A system as defined by claim 13 wherein said joining means resiliently biases said panels from a closed position to an open position in a spring like fashion.

17. A system as defined by claim 12 wherein said hanger defines a vertical rib and wherein said jaws each define said outer camming surfaces and at least one of the jaws defines a locator notch dimensioned to receive said vertical rib.

* * * * *